US008721097B2

(12) United States Patent
Guo et al.

(10) Patent No.: US 8,721,097 B2
(45) Date of Patent: May 13, 2014

(54) LED LAMP WITH IMPROVED LIGHT OUTPUT

(75) Inventors: Sheng-Shin Guo, Wufeng Township, Taichung County (TW); Chih-Hsuan Sun, Kaohsiung (TW); Tien-Ming Lin, Hsinchu (TW); Wei-Yu Yeh, Tainan (TW)

(73) Assignee: Taiwan Semiconductor Manufacturing Company, Ltd., Hsin-Chu (TW)

( * ) Notice: Subject to any disclaimer, the term of this patent is extended or adjusted under 35 U.S.C. 154(b) by 348 days.

(21) Appl. No.: 13/111,222

(22) Filed: May 19, 2011

(65) Prior Publication Data

US 2012/0293978 A1 Nov. 22, 2012

(51) Int. Cl.
*F21V 9/16* (2006.01)
*F21V 3/00* (2006.01)

(52) U.S. Cl.
USPC ..... 362/84; 362/311.01

(58) Field of Classification Search
USPC ..... 362/84, 311.01–311.02
See application file for complete search history.

(56) References Cited

U.S. PATENT DOCUMENTS

| | | | | |
|---|---|---|---|---|
| 2010/0172120 | A1* | 7/2010 | Wegh et al. | 362/84 |
| 2010/0259918 | A1 | 10/2010 | Rains, Jr. et al. | |
| 2010/0290208 | A1* | 11/2010 | Pickard | 362/84 |
| 2010/0308354 | A1 | 12/2010 | David et al. | |
| 2010/0314996 | A1 | 12/2010 | van de Ven et al. | |
| 2011/0267800 | A1* | 11/2011 | Tong et al. | 362/84 |
| 2012/0280256 | A1* | 11/2012 | Negley | 257/88 |

* cited by examiner

*Primary Examiner* — Joseph L Williams
(74) *Attorney, Agent, or Firm* — Haynes and Boone, LLP

(57) ABSTRACT

The present disclosure involves an LED lamp. The LED lamp includes a plurality of light-emitting diode (LED) light sources located on a substrate. At least a subset of the LED light sources is free of a phosphor coating. The LED lamp includes a multi-layered cap structure located over at least the subset of the LED light sources. The cap structure contains a phosphor material and a diffuser material. The cap structure is physically separated from the subset of the LED light sources by a gap. The LED lamp includes a cover structure positioned over and surrounding the LED light sources and the cap structure.

20 Claims, 12 Drawing Sheets

LED LAMP WITH IMPROVED LIGHT OUTPUT

BACKGROUND

The semiconductor integrated circuit (IC) industry has experienced rapid growth in recent years. Technological advances in IC materials and design have produced various types of ICs that serve different purposes. One type of these ICs includes photonic devices, such as light-emitting diode (LED) devices. LED devices emit light through movement of electrons in a semiconductor material when a voltage is applied. LED devices have increasingly gained popularity due to favorable characteristics such as small device size, long lifetime, efficient energy consumption, and good durability and reliability.

Among other practical applications, LED devices have been used to make lamps that offer advantages over traditional lamps, such as incandescent lamps. For example, LED lamps can produce more light for the same amount of power compared to incandescent lamps. However, LED lamps produce heat when radiating light. Conventional LED lamps may experience reduced light output when it becomes heated, thereby degrading the performance of LED lamps.

Therefore, although conventional LED lamps have been generally adequate for their intended purposes, they have not been entirely satisfactory in every aspect.

BRIEF DESCRIPTION OF THE DRAWINGS

Aspects of the present disclosure are best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

It is to be understood that the following disclosure provides many different embodiments, or examples, for implementing different features of the invention. Specific examples of components and arrangements are described below to simplify the present disclosure. These are, of course, merely examples and are not intended to be limiting. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Various features may be arbitrarily drawn in different scales for the sake of simplicity and clarity.

Due to advancements in light-emitting diode (LED) technology, lighting instruments using LED devices have gained popularity recently. These lighting instruments include LED lamps, which are solid-state lamps that use a plurality of LED devices as the source of light. Phosphor-converted LEDs (PCLEDs) are used to implement some of these LED lamps. These PCLED lamps use LED devices having a relatively short wavelength (for example blue) and coat the LED devices with a phosphor material. The phosphor material absorbs a portion of the emitted light (for example blue light) and in turn emits light with different wavelengths, for example, yellow light. The converted yellow light and unconverted portion of the emitted blue light is perceived as white light. These LED lamps offer low production costs and high color rendering capabilities. However, the light output performance for these LED lamps may suffer as they become heated, which may occur during its operation.

In more detail, the light output of a LED device may drop due to two reasons: 1. when the emitter of the LED device is turned on (during operation), the temperature of the LED die will rise, which will cause the light output to drop; 2. the heat flux may transfer from the LED die to the phosphor coating, which causes a drop in light output as well. In other words, the light output performance of the LED device has an inverse correlation with the temperature of the LED device. The drop of light output degrades the performance of the LED lamps and is therefore undesirable. Accordingly, the present disclosure will introduce several embodiments that can each alleviate the light output degradation issues associated with conventional LED lamps.

Figure 1A:
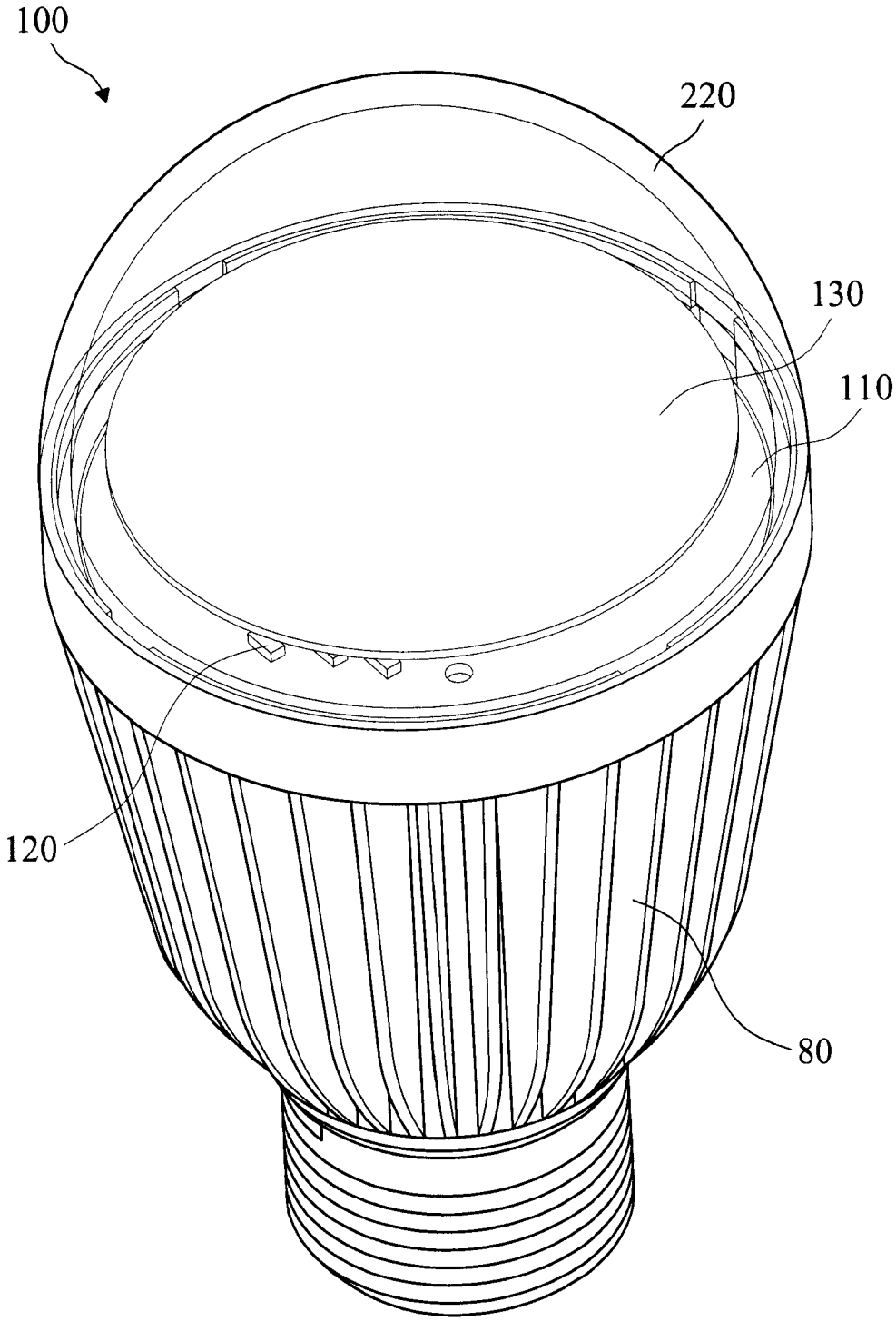
FIGS. 1A-1C are a perspective view, a cross-sectional view, and a top view of a LED lighting apparatus according to an embodiment of the present disclosure.
Figure 1B:
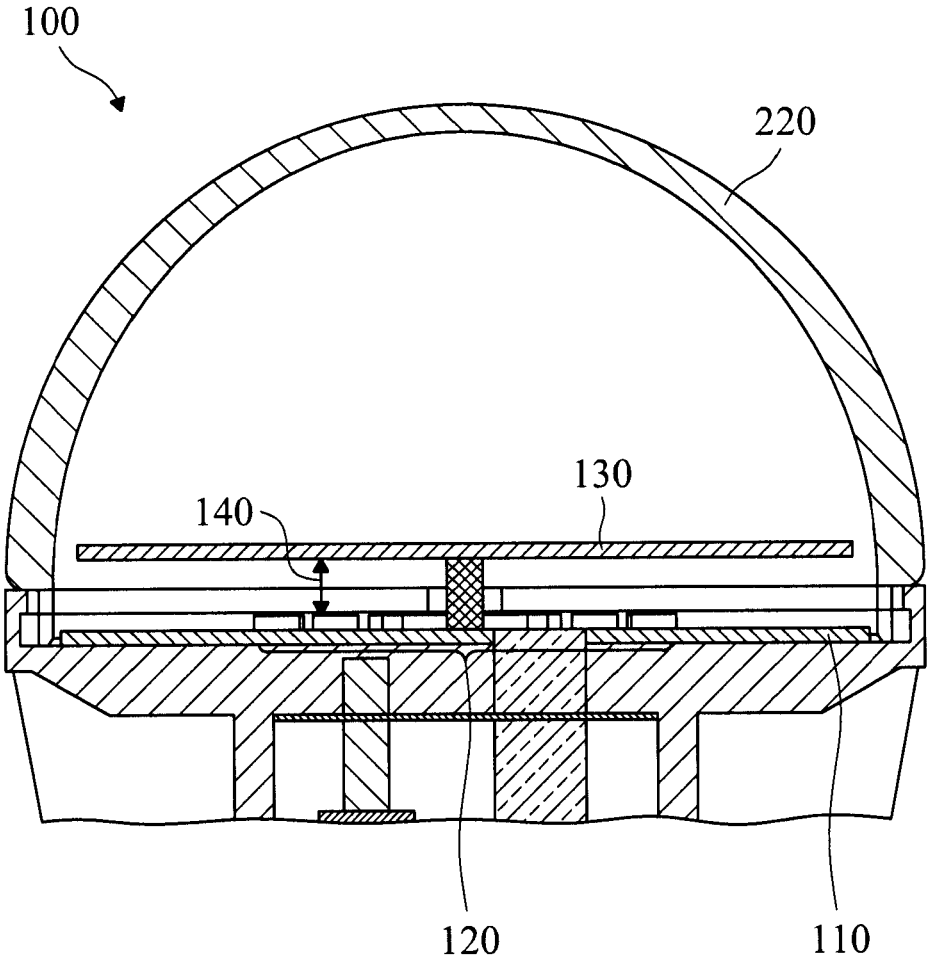
Figure 1C:
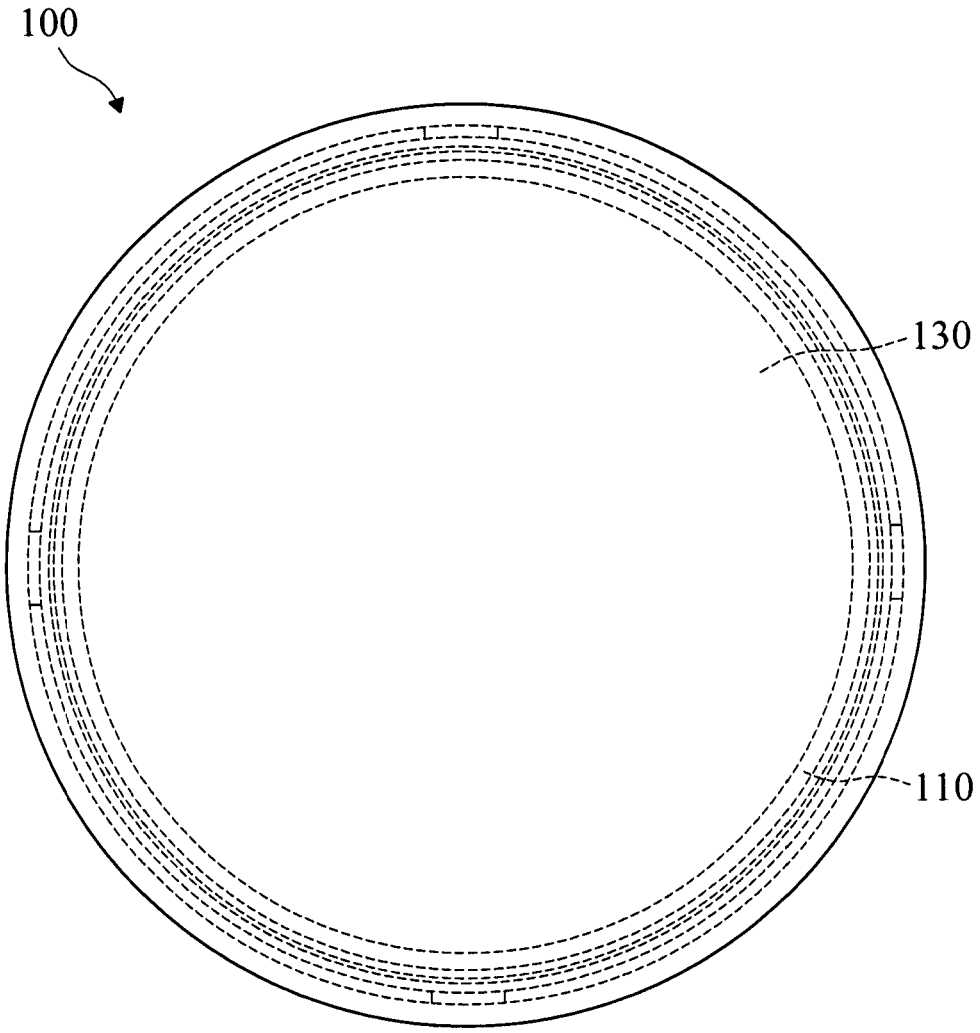

FIG. 1A is a simplified perspective view of an LED lighting apparatus 100 according to an embodiment of the present disclosure; FIG. 1B is a simplified cross-sectional view of the LED lighting apparatus 100; and FIG. 1C is a simplified top view of the LED lighting apparatus 100. The LED lighting apparatus 100 is a lamp in the embodiment shown, but may include other lighting arrangements and configurations in other embodiments.

The LED lighting apparatus 100 include a heat sink 80. The heat sink 80 is shaped to accommodate arrays of LED devices in a configuration that produces a nearly uniform light pattern. In this example, the heat sink 80 is made of a thermally conductive material. The particular shape of the heat sink is designed to provide a framework for a familiar light bulb shape while at the same time spreading heat away from the LED devices and radiating as much heat as possible to the ambient atmosphere. To enhance heat transfer, the heat sink may have fins that protrude outwardly from a central axis of the LED lighting apparatus 100. The fins may have substantial surface area exposed to ambient atmosphere to facilitate heat transfer.

The LED lighting apparatus 100 includes a substrate 110. The substrate 110 is a non-metal material. In one embodiment, the substrate 110 contains a ceramic material. In other embodiments, the substrate 110 may contain a silicon material or a plastic material. As some examples, the following materials may be used to implement the substrate 110: AlN, Al2O3, MCPCB, Si3N4, Silicon, BeO, or combinations thereof. The substrate 110 may or may not contain active circuitry and may also be used to establish interconnections.

A plurality of LED devices 120 are formed on the substrate 110. The LED devices 120 each include a P/N junction formed by oppositely doped layers. In one embodiment, the oppositely doped layers may include oppositely doped gallium nitride (GaN) layers. For example, one of these layers is doped with an n-type dopant such as carbon or silicon, and the oppositely doped layer is doped with a p-type dopant such as magnesium. In other embodiments, the n-type and p-type dopants may include different materials.

In an embodiment, the LED devices 120 may each include a multiple-quantum well (MQW) layer that is disposed in between the oppositely doped layers. The MQW layer includes alternating (or periodic) layers of gallium nitride and indium gallium nitride (InGaN). For example, the MQW layer may include a number of gallium nitride layers and a number of indium gallium nitride layers, wherein the gallium nitride layers and the indium gallium nitride layers are formed in an alternating or periodic manner.

The doped layers and the MQW layer may all be formed by an epitaxial growth process known in the art. After the completion of the epitaxial growth process, a P/N junction (or a P/N diode) is created by the disposition of the MQW layer between the doped layers. When an electrical voltage (or electrical charge) is applied to the doped layers, electrical current flows through the LED devices 120, and the MQW layer emits radiation such as light in a visible spectrum. The color of the light emitted by the MQW layer corresponds to the wavelength of the light. The wavelength of the light (and hence the color of the light) may be tuned by varying the composition and structure of the materials that make up the MQW layer. According to an embodiment of the present disclosure, the LED devices 120 are configured to emit blue light. The LED devices 120 may also include electrodes or contacts that allow the LED devices to be electrically coupled to external devices.

Traditional LED devices typically have a phosphor layer coated around the LED devices. The phosphor layer may include either phosphorescent materials and/or fluorescent materials. In practical LED applications, the phosphor layer may be used to transform the color of the light emitted by an LED device. For example, the phosphor layer can transform a blue light emitted by an LED device into a different wavelength light. By changing the material composition of the phosphor layer, the desired light color emitted by the LED device may be achieved. However, as discussed above, the phosphor layer coated around the traditional LED device may lead to decreased light output of the LED device. Therefore, the LED devices 120 shown in FIGS. 1A-1C have no phosphor coating formed thereon. In an embodiment, the LED devices 120 include blue die emitters having no phosphor coating.

The LED lighting apparatus 100 includes a cap structure 130 that is disposed over the LED devices 120. The cap structure 130 may have a plurality of different layers and may therefore also be referred to as a multilayer cap 130. In an embodiment, the cap structure 130 has an approximately round or circular shape and circumferentially covers all the LED devices 120 below. Stated differently, the LED devices 120 are not visible from the top view of FIG. 1C, because they are all overlapped by the cap structure 130. The cap structure 130 is separated from the LED devices 120 by a distance or gap 140 (from the cross-sectional view of FIG. 1B). The distance 140 is greater than or equal to about 0.5 millimeter (mm). In an embodiment, the distance 140 is in a range from about 0.5 mm to about 10 mm.

Figure 2A:
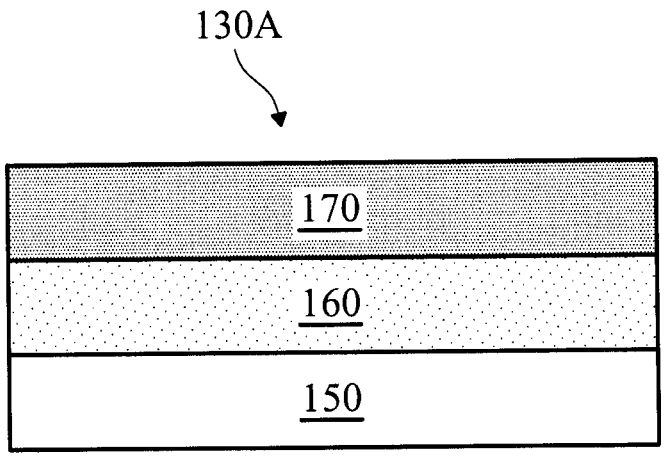
FIGS. 2A-2C are cross-sectional views of several different embodiments of a cap structure that is used as a component of the LED lighting apparatus of FIGS. 1A-1C.

The cap structure 130 may be implemented according to a number of different embodiments. The details of these embodiments are discussed below with reference to FIGS. 2A, 2B, and 2C. Referring to FIG. 2A, a diagrammatic cross-sectional side view of a cap structure 130A is shown according to an embodiment. The cap structure 130A includes a layer 150, a layer 160, and a layer 170, in which the layer 160 is disposed (sandwiched) between the layers 150 and 170. With reference to FIGS. 1A-1C, the layer 150 of the cap structure 130A is the layer facing the LED devices 120. The layers 150, 160, and 170 may each be one of: a substrate layer, a diffuser layer, and a phosphor layer. In more detail, the layers 150-170 may be arranged in one of the following six configurations according to Table 1 below:

TABLE 1

| | Configuration 1 | Configuration 2 | Configuration 3 | Configuration 4 | Configuration 5 | Configuration 6 |
|---|---|---|---|---|---|---|
| Layer 170 | Substrate layer | Substrate layer | Phosphor layer | Diffuser layer | Diffuser layer | Phosphor layer |
| Layer 160 | Diffuser layer | Phosphor layer | Substrate layer | Substrate layer | Phosphor layer | Diffuser layer |
| Layer 150 | Phosphor layer | Diffuser layer | Diffuser layer | Phosphor layer | Substrate layer | Substrate layer |

For example, according to configuration 1, the layer 170 is the substrate layer, the layer 160 is the diffuser layer, and the layer 150 is the phosphor layer; according to configuration 2, the layer 170 is the substrate layer, the layer 160 is the phosphor layer, and the layer 150 is the diffuser layer, so on and so forth.

Among other things, the substrate layer provides mechanical support for the other layers. In one embodiment, the substrate layer includes a polycarbonate (PC) material. In another embodiment, the substrate layer may include a Polymethyl methacrylate (PMMA) material. In yet another embodiment, the substrate layer may include a glass material.

The diffuser layer helps scatter the light emitted by the LED devices 120 so as to make the light distribution more uniform. In more detail, it would be undesirable to have a light output that is very intense (bright) in some spots and weak (dim) in other spots. Since the diffuser material scatters the light in all different direction, the result is that the light output is less likely to contain spots having varying degrees of brightness—thereby improving light output uniformity. In an embodiment, the diffuser layer includes a liquid silicone material dispersed with diffuser particles. The diffuser layer may be sprayed onto the substrate layer and then cured at a high temperature (for example a temperature higher than about 80 degrees Celsius) for a predetermined period of time (for example, longer than about 1 hour). The diffuser particles may include PMMA as well.

As discussed above, the phosphor layer helps convert light from one spectrum to another, thereby changing the color of the light. In an embodiment, the phosphor layer includes a liquid silicon material with phosphor particles. The cap structure 130A can be formed with a roll-to-roll technique known in the art. The cap structure 130A may also be formed with a suitable mask process known in the art. Because the cap structure 130A contains both the phosphor material and the diffuser material, it can convert the color of the light emitted from the LED devices 120 and allow the light to be more uniformly distributed.

Figure 2B:
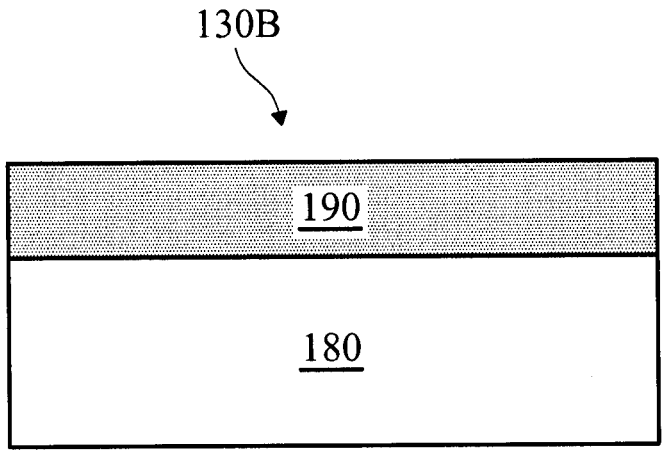

Referring to FIG. 2B, a diagrammatic cross-sectional side view of a cap structure 130B is shown according to another embodiment. The cap structure 130B includes a layer 180 and a layer 190. With reference to FIGS. 1A-1C, the layer 180 of the cap structure 130B is the layer facing the LED devices 120. The layers 180 and 190 may each be one of: a substrate layer and a diffuser layer mixed with phosphor particles. In more detail, the layers 180-190 may be arranged in one of the following two configurations according to Table 2 below:

TABLE 2

| | Configuration 1 | Configuration 2 |
|---|---|---|
| Layer 190 | Substrate layer | Diffuser layer mixed with phosphor |
| Layer 180 | Diffuser layer mixed with phosphor | Substrate layer |

For example, according to configuration 1, the layer 190 is the substrate layer, and the layer 180 is the diffuser layer mixed with phosphor particles; according to configuration 2, the layer 180 is the substrate layer, and the layer 190 is the diffuser layer mixed with phosphor particles. The substrate layer may include a material composition similar to that of the substrate layer of FIG. 2A. The diffuser layer mixed with phosphor particles may be viewed as a combination of the diffuser layer and the phosphor layer of FIG. 2A. Alternatively stated, a plurality of phosphor particles capable of converting lighting spectrum are mixed in a diffuser layer similar to the diffuser layer of FIG. 2A in a relatively uniform manner. The cap structure 130B can be formed with a roll-to-roll technique known in the art. The cap structure 130B may also be formed with a suitable mask process known in the art.

Figure 2C:
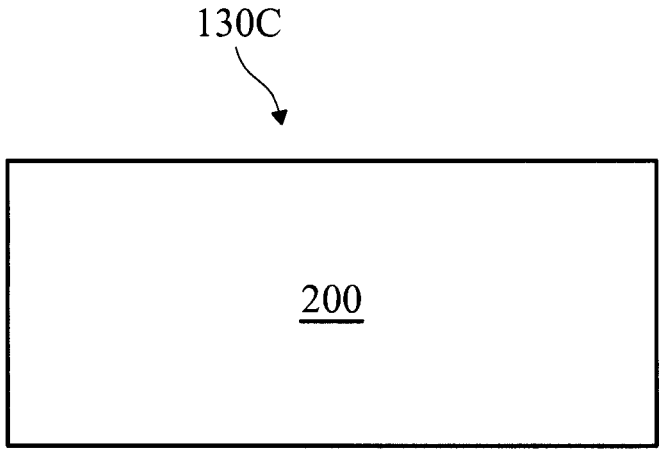

Referring to FIG. 2C, a diagrammatic cross-sectional side view of a cap structure 130C is shown according to yet another embodiment. The cap structure 130C includes a layer 200 that is a combination of the substrate layer, the diffuser layer, and the phosphor layer discussed above. In other words, the diffuser layer, the phosphor particles, and the substrate are all mixed together to create the layer 200. In an embodiment, the layer 200 is created by an injection molding technique known in the art. In an embodiment, the cap structures 130A, 130B, and 130C may each have a thickness that is in a range from about 1 micron to about 300 microns.

Recall that in conventional LED devices, the phosphor material is coated directly on the LED dies that radiate heat while in operation. As such, the phosphor material is greatly impacted by the heat outputted by the LED dies. In comparison, the embodiment of the LED lighting apparatus shown in FIGS. 1A-1C utilize a cap structure 130 containing a phosphor material, where the cap structure 130 can be implemented according to any one of the embodiments shown in FIGS. 2A-2C. The cap structure 130 is physically spaced apart from the LED devices 120 by the distance 140. This physical separation means the heat (thermal energy) radiated by the LED devices 120 will not impact the phosphor material in the cap structure 130 as much as in conventional LED devices, since thermal energy is reduced as a function of distance during its propagation. Stated differently, the thermal energy received ("felt") by the phosphor material in the cap structure 130 is substantially lower than the thermal energy radiated by the LED dies. Thus, the phosphor material in the cap structure 130 experiences lower temperatures compared to traditional phosphor materials coated around the LED dies.

Furthermore, the LED devices 120 themselves may experience a lower temperature compared to conventional LED devices, since thermal energy can now be more easily radiated without being blocked by the phosphor coating. In other words, the physical separation of the LED devices 120 and the cap structure may improve thermal dissipation by not trapping the heat inside or near the LED devices 120.

The reduced temperature of the phosphor material and the LED devices 120 result in an increased light output. As discussed above, the light output efficiency of LED devices is inversely correlated with temperature. As temperature rises, the amount of light output is reduced. As temperature drops, the amount of light output is increased. Thus, since the present embodiment allow for a reduced temperature while the LED devices 120 are in operation, the LED devices 120 will have better light output compared to conventional LED devices. For example, conventional LED devices (with phosphor coating) may have a light output that is less than 90%, wherein the percentage is measured against a full light output with no degradation due to thermal heating issues. In comparison, the LED devices 120 herein may have a light output that is better than 95%, for example between about 95% and 96%.

The reduced temperature of the phosphor material and the LED devices 120 also enhances the reliability of the LED lighting apparatus 100. This is at least in part due to the fact that reduced operating temperatures lead to less wear and tear on the parts, for example on the LED emitter dies. According to test results, the LED lighting apparatus 100 may have an emitter life span of greater than about 25,000 hours, which is at least several thousand hours longer than conventional LED emitters.

It is understood that a suitable range is chosen for the distance 140 to optimize the performance of the LED lighting apparatus 100. In an embodiment, the range between about 0.5 mm to about 10 mm is chosen for the distance 140 so as to balance the objective of dissipating a sufficient amount of heat and the objective of producing a uniform white light output. If the distance 140 is too small, then the cap structure 130 is located too close to the LED devices 120 and may still lead to too much heat being trapped at or near the LED devices, which is undesirable because it reduces light output and subjects the phosphor material to higher temperatures. On the other hand, if the distance 140 is too great, then a significant amount of blue light emitted by the LED devices may escape the LED lighting apparatus 100 without being converted into a different wavelength light by the phosphor material in the cap structure 130. Also, the light output may not achieve the desired degree of uniformity, since the light may not be sufficiently scattered by the diffuser material in the cap structure 130 before the light propagates outside the LED lighting apparatus 100. For these reasons, a value for the distance 140 is carefully chosen so as to satisfy both of the objectives above without sacrificing the other.

The LED lighting apparatus 100 may also includes a dome-like cover structure 220 that surrounds or encloses the substrate 110, the LED devices 120, and the cap structure 130. The cover structure 220 may be a diffuser cap 220. Similar to the diffuser material in the cap structure 130, the diffuser cap 220 serves a scattering function to the emitted light so as to make the light distribution more uniform. For conventional LED lighting apparatus, only a phosphor material (and not diffuser material) is coated around the conventional LED dies. Thus, to make light distribution more uniform, diffuser caps similar to the diffuser cap 220 may be required for conventional LED lighting apparatus. Here, since the cap structure 130 may already include a sufficient amount of diffuser material to produce uniformly distributed light, the diffuser cap 220 may not be necessary. Alternatively, if the diffuser cap 220 is assembled as a part of the LED lighting apparatus 100, then the diffuser cap 220 may have a lower diffuser material content than traditional cover structures.

Figure 3A:
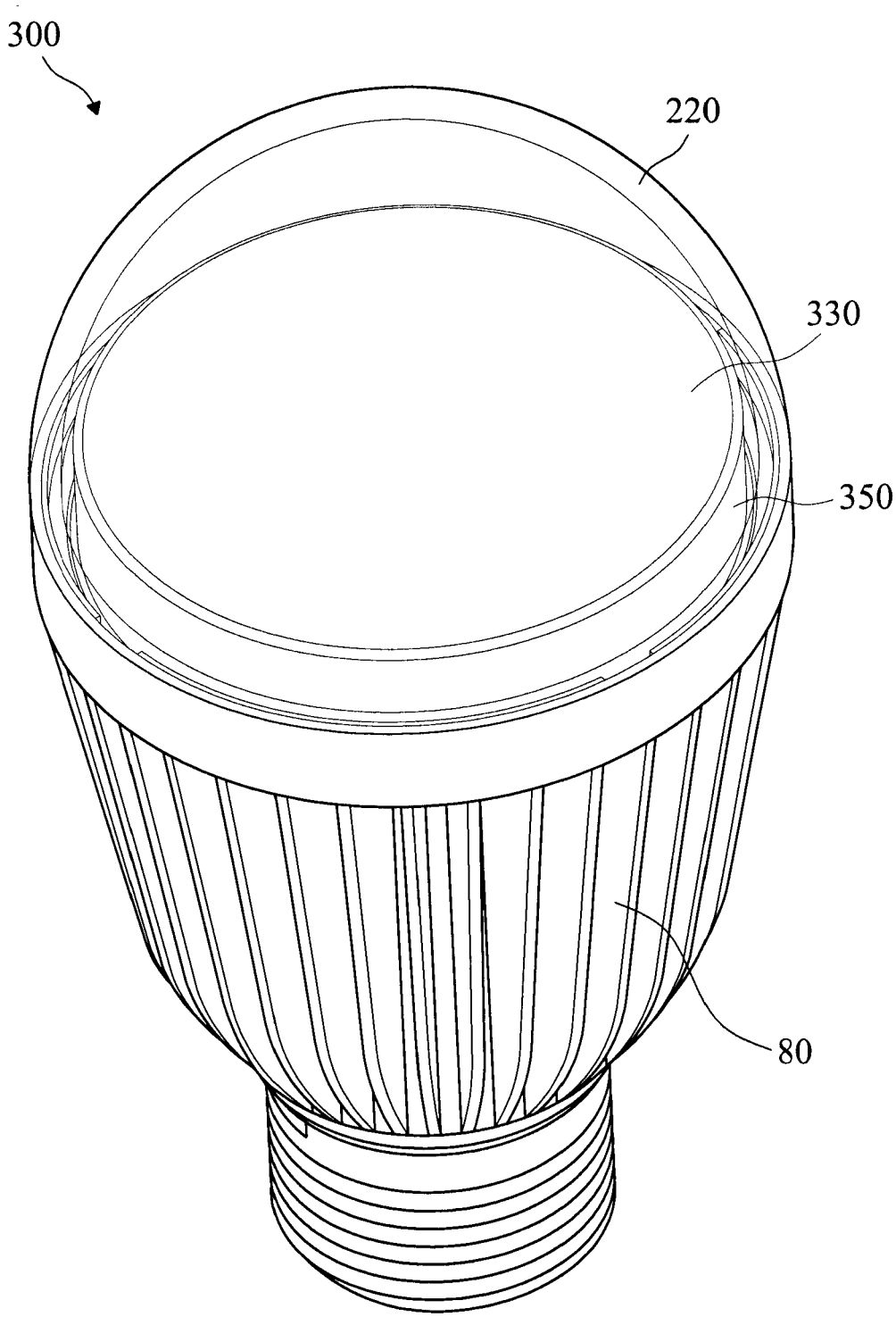
FIGS. 3A-3C are a perspective view, a cross-sectional view, and a top view of a LED lighting apparatus according to an alternative embodiment of the present disclosure.
Figure 3B:
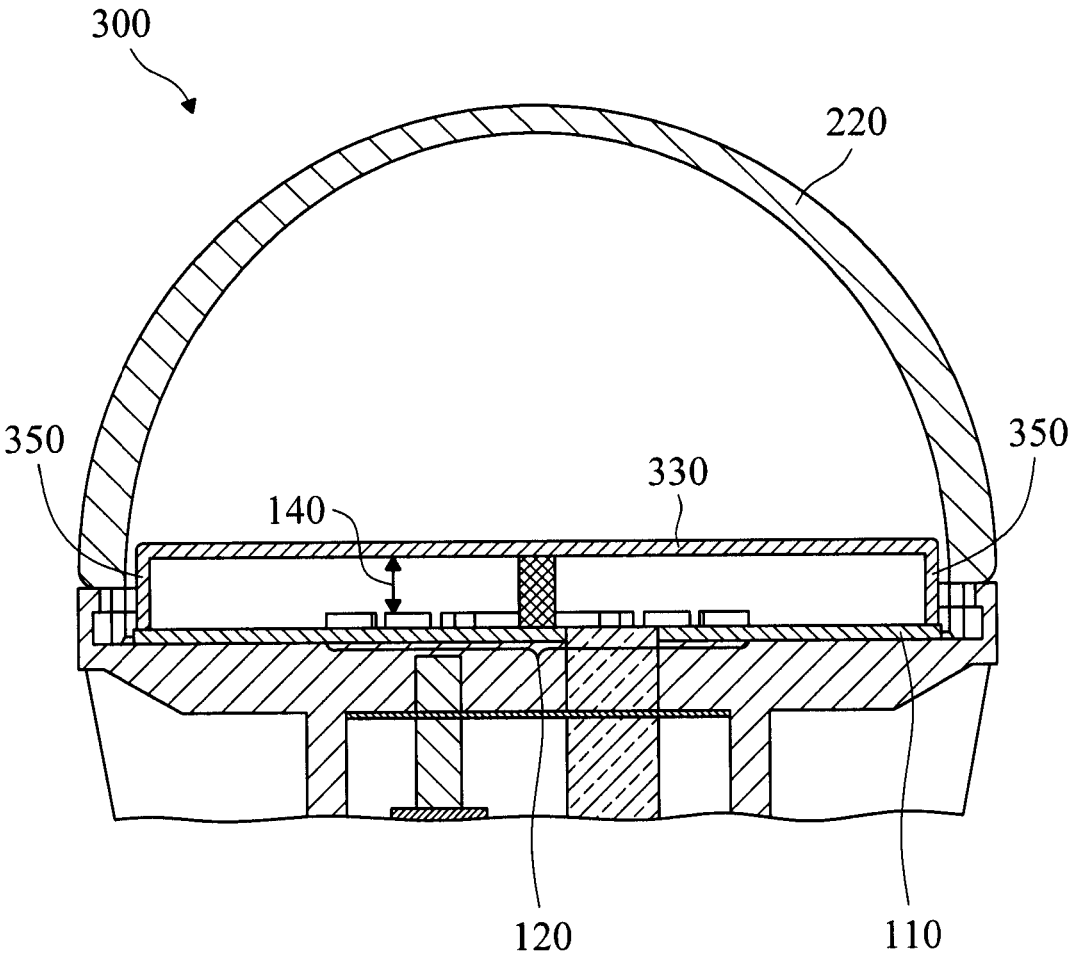
Figure 3C:
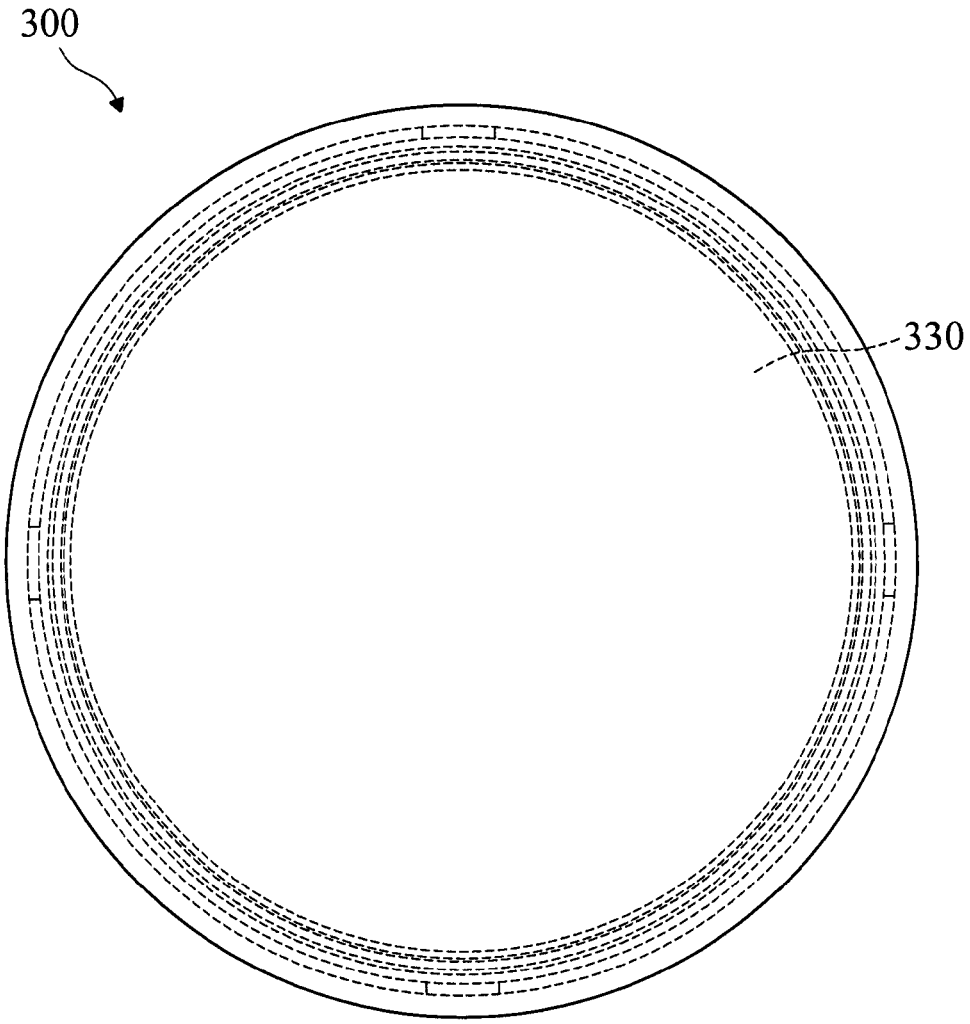

Alternative embodiments of the LED lighting apparatus are now discussed. One of these alternative embodiments is illustrated in FIGS. 3A-3C. In more detail, FIG. 3A is a simplified perspective view of an alternative embodiment of an LED lighting apparatus 300; FIG. 3B is a simplified cross-sectional view of the LED lighting apparatus 300; and FIG. 3C is a simplified top view of the LED lighting apparatus 300. The LED lighting apparatus 300 is a lamp in the embodiment shown, which includes some components and features similar to the LED light device 100 shown in FIGS. 1A-1C. For the sake of clarity and consistency, these similar components and features will be labeled the same throughout FIGS. 1A-1C and FIGS. 3A-3C.

Similar to the LED lighting apparatus 100, the LED lighting apparatus 300 includes a heat sink 80 for dissipating heat, a plurality of LED devices 120 (not viewable from the perspective view of FIG. 3A or the top view of FIG. 3C) for producing light, and an optional diffuser cap 220 for scattering the emitted light so as to make the light distribution more uniform. The LED lighting apparatus 300 also includes a cap structure 330 that is similar to the cap structure 130 (of the LED lighting apparatus 100) in some aspects and yet different from the cap structure 130 in other aspects. The cap structure 330 is similar to the cap structure 130 in that they each contain a substrate material, a phosphor material, and a diffuser material, and they can each be implemented according to the various configurations discussed above with reference to FIGS. 2A-2C. And similar to the cap structure 130, the cap structure 330 is also disposed above and separated from the LED devices 120 by the distance 140.

Unlike the cap structure 130, however, the cap structure 330 includes a side portion 350 that circumferentially surrounds the LED devices 120, such that the LED devices 120 are sealed or enclosed by the cap structure 330 and the substrate 110. In other words, the cap structure 330 resembles a cup that is flipped upside down over the LED devices 120. This "cup" makes the LED devices 120 from the top view and the side view. It is understood that the LED devices 120 are shown in the cross-sectional view of FIG. 3B merely for the sake of providing an illustration, and that they would not be directly visible in a real world application. For these reasons, the light emitted by the LED devices 120 needs to travel through the side portion 350 of the cap structure 330 as well.

The LED lighting apparatus 300 offers substantially the same benefits discussed above in association with the LED lighting apparatus 100, namely a lower operating temperature and an increased light output. In addition, since the LED lighting apparatus 300 completely seals the LED devices, the light uniformity and color integrity may improve, since all of the emitted light will be scattered and color-converted by the cap structure 330 before being leaving the LED lighting apparatus 300. But due to the more sophisticated shape of the cap structure 330, the LED lighting apparatus 300 may be slightly more expensive to manufacture than the LED lighting apparatus 100 of FIGS. 1A-1C.

Figure 4A:
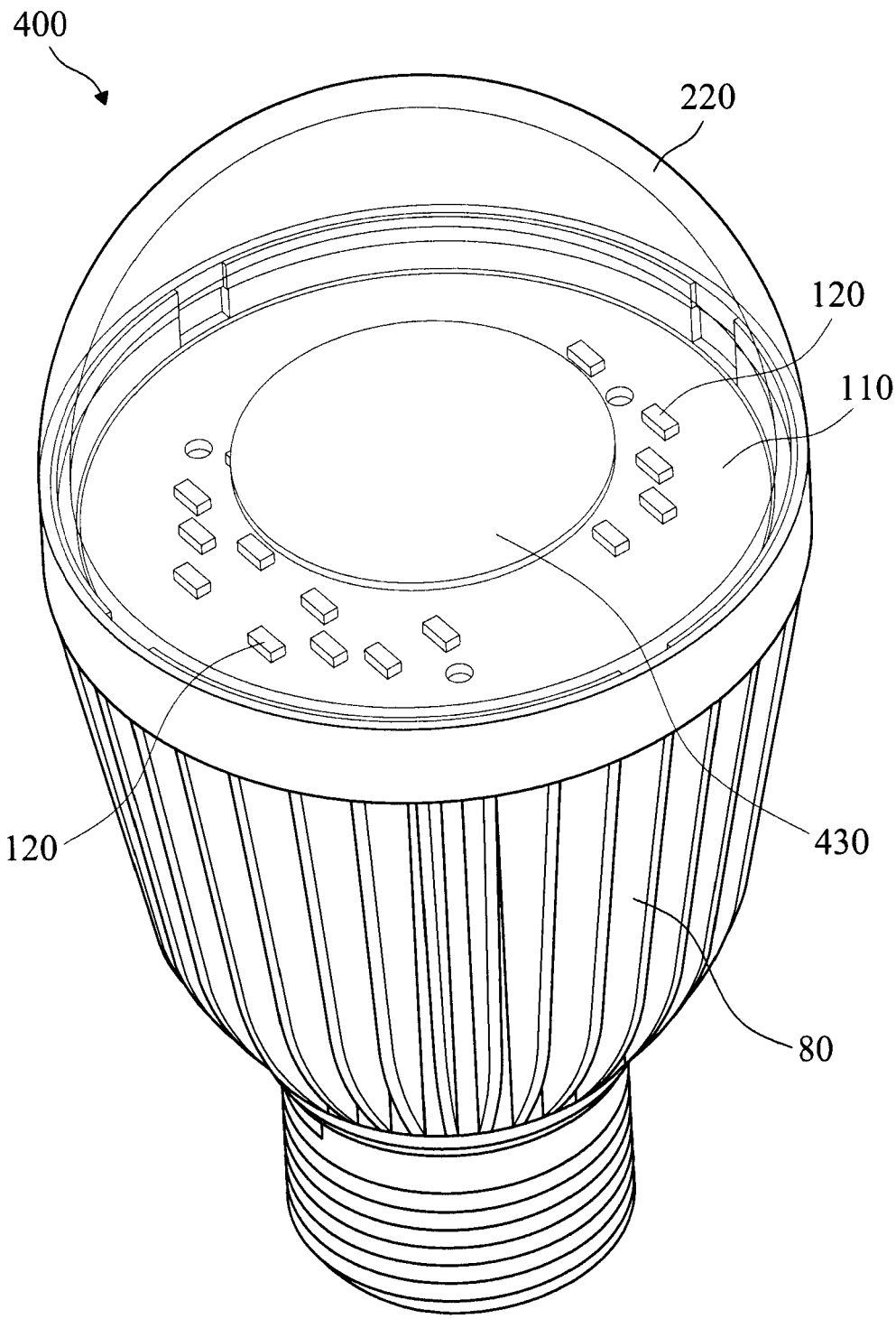
FIGS. 4A-4C are a perspective view, a cross-sectional view, and a top view of a LED lighting apparatus according to another alternative embodiment of the present disclosure.
Figure 4B:
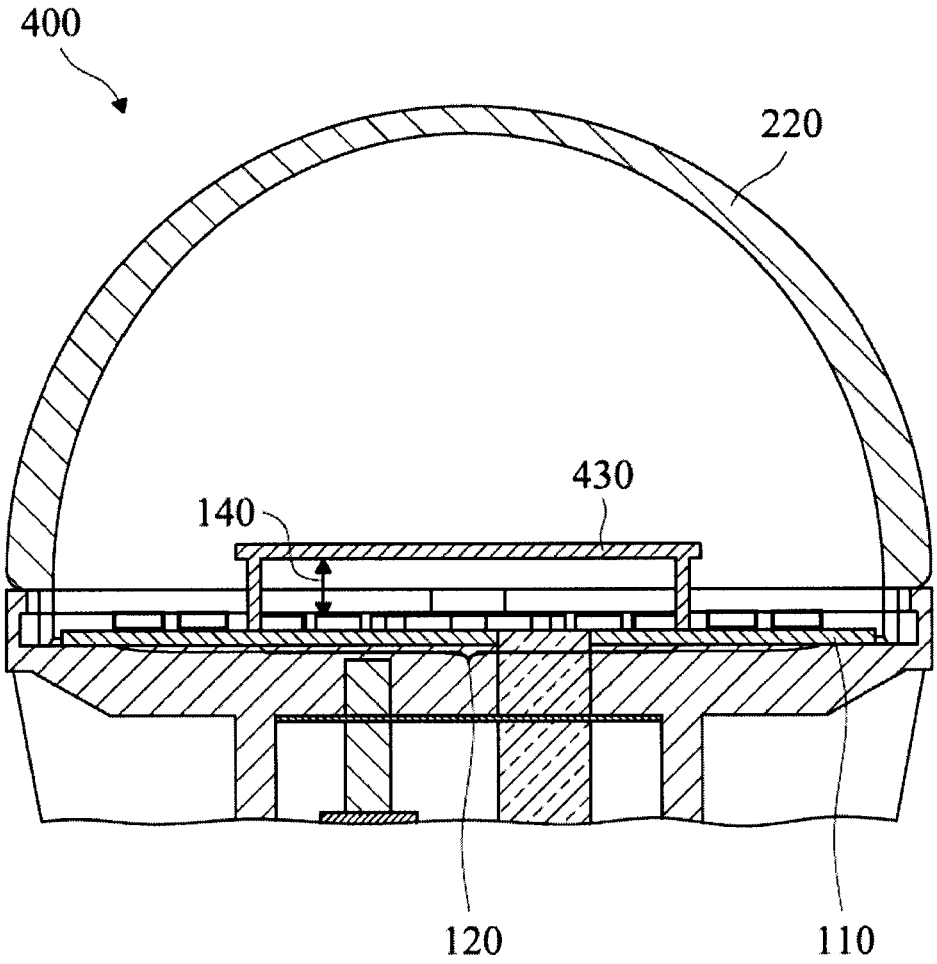
Figure 4C:
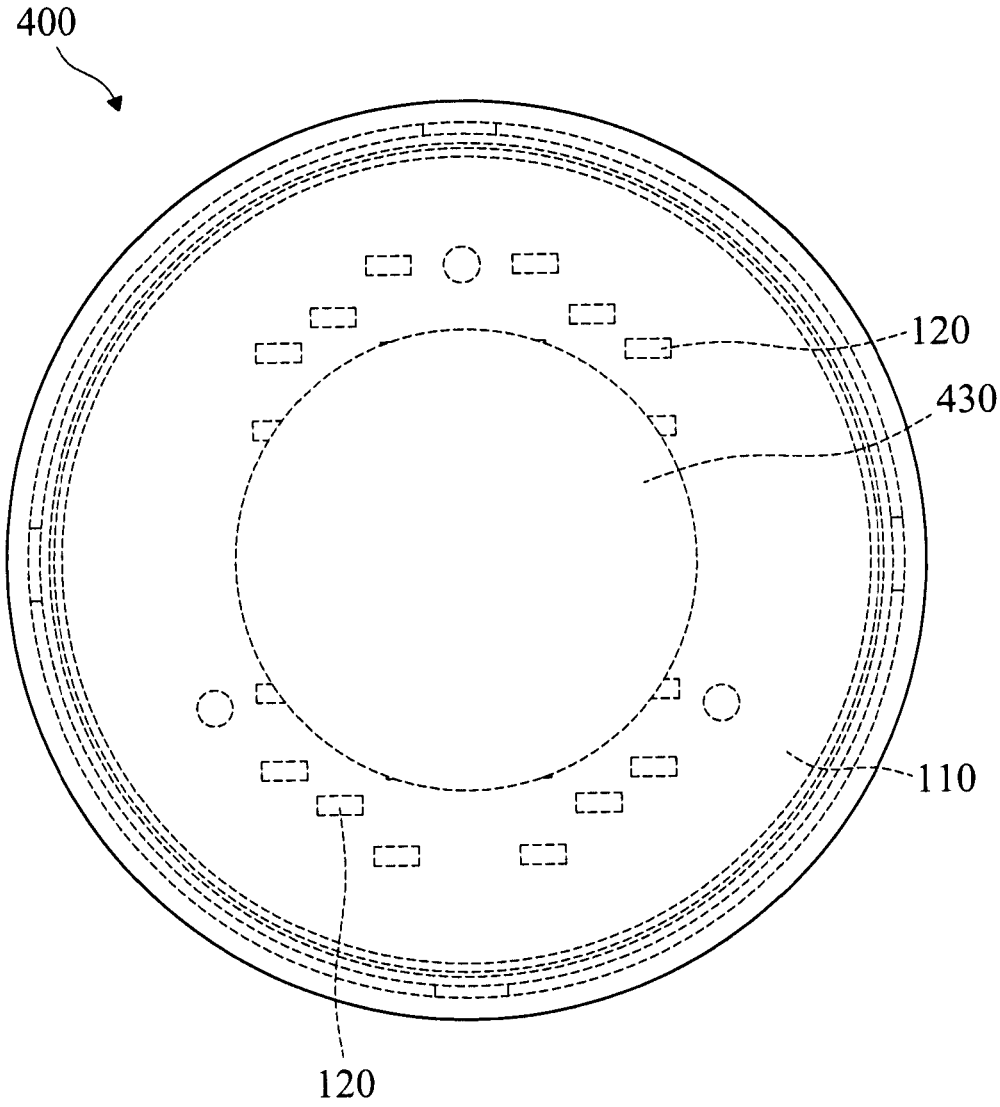

Another one of the alternative embodiments of the LED lighting apparatus is illustrated in FIGS. 4A-4C. In more detail, FIG. 4A is a simplified perspective view of another alternative embodiment of an LED lighting apparatus 400; FIG. 4B is a simplified cross-sectional view of the LED lighting apparatus 400; and FIG. 4C is a simplified top view of the LED lighting apparatus 400. The LED lighting apparatus 400 is a lamp in the embodiment shown, which includes some components and features similar to the LED light device 100 shown in FIGS. 1A-1C. For the sake of clarity and consistency, these similar components and features will be labeled the same throughout FIGS. 1A-1C and FIGS. 4A-4C.

Similar to the LED lighting apparatus 100, the LED lighting apparatus 400 includes a heat sink 80 for dissipating heat, a plurality of LED devices 120 for producing light, and an optional diffuser cap 220 for scattering the emitted light so as to make the light distribution more uniform. The LED lighting apparatus 400 also includes a cap structure 430 that is similar to the cap structure 130 (of the LED lighting apparatus 100) in some aspects and yet different from the cap structure 130 in other aspects. The cap structure 430 is similar to the cap structure 130 in that they each contain a substrate material, a phosphor material, and a diffuser material, and they can each be implemented according to the various configurations discussed above with reference to FIGS. 2A-2C. And similar to the cap structure 130, the cap structure 430 is also disposed above and separated from the LED devices 120 by the distance 140.

Unlike the cap structure 130, however, the cap structure 430 does not circumferentially cover all the LED devices 120. In other words, the cap structure 430 resembles a round disk that has a substantially smaller diameter/circumference than that of the substrate 110, such that at least a subset of the LED devices 120 are "exposed" or uncovered by the cap structure 430. As such, the light emitted by these exposed LED devices 120 need not travel through the cap structure 430 before leaving the LED lighting apparatus 400. These exposed LED devices 120 may be manufactured as conventional LED devices, in that they may have a phosphor material coated thereon. In an embodiment, a ratio between a diameter of the substrate 110 and a diameter of the cap structure 430 is about 5:3.

With respect to performance, the LED lighting apparatus 400 is comparable to the LED lighting apparatus 100 and 300. Typically, the LED devices 120 near the center region of the substrate 110 are hotter than the LED devices 120 near the periphery regions of the substrate 110. For example, the temperature difference between the center region and the periphery region may be as much as (or exceed) 10 degrees Celsius. This means that it is more important to reduce the temperature of the LED devices 120 near the center region. In the LED lighting apparatus 400, the LED devices 120 covered by the cap structure 430 are manufactured without the phosphor coating and therefore have reduced temperatures. The LED devices 120 uncovered by the cap structure 430 may be manufactured as conventional LED devices (with the phosphor coating), but since these LED devices are located near the periphery region of the substrate 110, they will not substantially contribute to the increase in temperature. Therefore, the LED lighting apparatus 400 may still have an operating temperature that is similar to the LED lighting apparatus 100, which is lower than conventional LED lighting apparatuses.

For these reasons discussed above, the LED lighting apparatus 400 offers substantially the same benefits discussed above in association with the LED lighting apparatus 100, namely a lower operating temperature and an increased light output. In addition, the LED lighting apparatus 400 allows the exposed subset of LED devices 120 to be implemented as traditional LED devices, which are cheaper to manufacture. The cap structure 430 itself is simpler and smaller than the cap structure 130 (FIGS. 1A-1C) or the cap structure 330 (FIGS. 3A-3C) and thus may be easier and cheaper to manufacture as well. For these reasons, the LED lighting apparatus 400 may have a lower manufacturing cost than the LED lighting apparatuses 100 and 300'.

Figure 5:
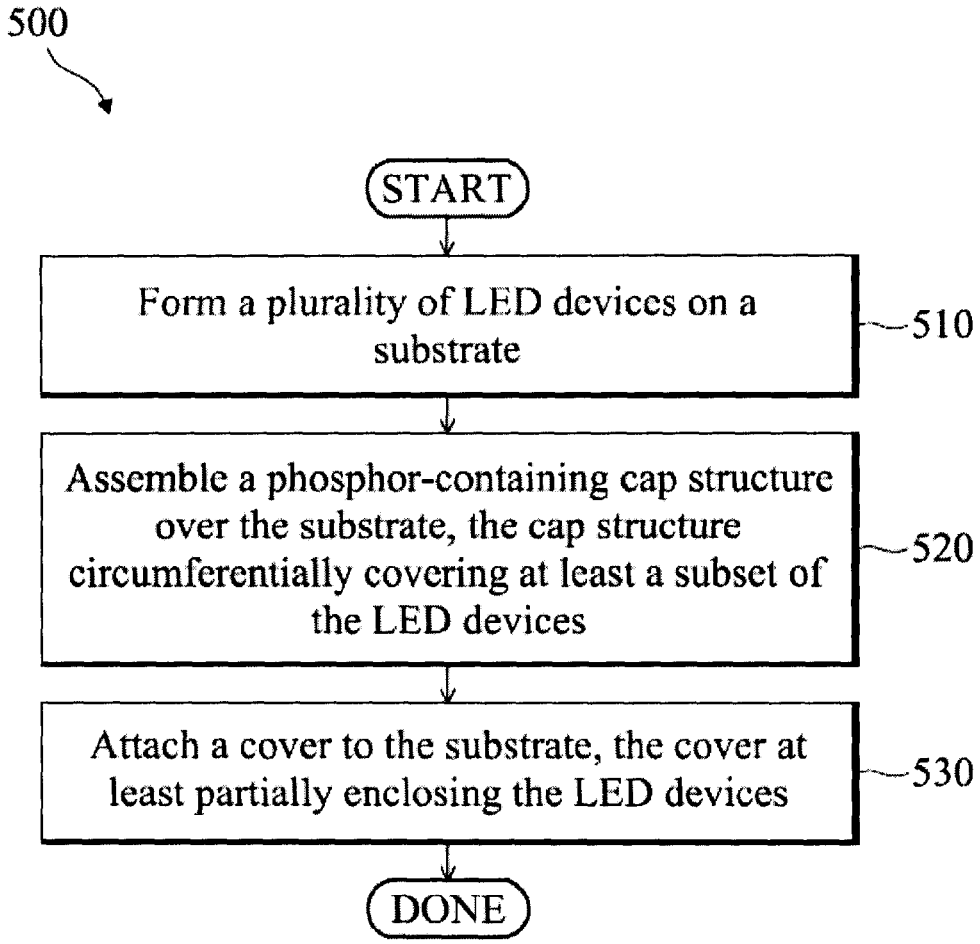
FIG. 5 is a flowchart illustrating a method for fabricating a LED lighting apparatus according to various aspects of the present disclosure.

FIG. 5 is a flowchart illustrating a method 500 of fabricating an LED lighting apparatus according to various aspects of the present disclosure. The method 500 includes a block 510, in which a plurality of LED devices is formed on a substrate. The LED devices may have blue die emitters. The method 500 continues with block 520 in which a phosphor-containing cap structure is assembled over the substrate. The cap structure circumferentially covers at least a subset of the LED devices. A gap physically separates the cap structure from the LED devices. The cap structure contains a phosphor material and a diffuser material. The method 500 continues with block 530 in which a cover is attached to the substrate. The cover at least partially encloses the LED devices. In an embodiment, the cover contains a diffuser material.

One of the broader forms of the present disclosure involves a lighting apparatus. The lighting apparatus includes a substrate; a plurality of light-emitting diode (LED) devices disposed on the substrate; and a cap disposed over at least a subset of the LED devices; wherein: the cap is spaced apart from the subset of the LED devices by a distance; and the cap includes a material that is operable to convert a first spectrum of light emitted by the LED devices to a second spectrum that is different from the first spectrum.

Another one of the broader forms of the present disclosure involves an LED lamp. The LED lamp includes a plurality of light-emitting diode (LED) light sources located on a substrate, at least a subset of the LED light sources being free of a phosphor coating; a cap structure located over at least the subset of the LED light sources, the cap structure containing a phosphor material and a diffuser material, wherein the cap structure is physically separated from the subset of the LED light sources by a gap; and a cover structure positioned over and surrounding the LED light sources and the cap structure.

Yet another one of the broader forms of the present disclosure involves a method of fabricating a lighting apparatus. The method includes: forming a plurality of light-emitting diode (LED) devices on a substrate; assembling a phosphor-containing cap structure over the substrate, the cap structure circumferentially covering at least a subset of the LED devices, wherein a gap physically separates the cap structure from the LED devices; and attaching a cover to the substrate, the cover at least partially enclosing the LED devices.

The foregoing has outlined features of several embodiments so that those skilled in the art may better understand the detailed description that follows. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

What is claimed is:

1. A lighting apparatus, comprising:

a substrate;

a plurality of light-emitting diode (LED) devices disposed on the substrate; and a multi-layered cap disposed over at least a subset of the LED devices;

wherein:

the cap is spaced apart from the subset of the LED devices by a distance; and the cap includes three mutually exclusive layers, a first one of the layers being a substrate layer, a second one of the layers being a diffuser layer, and a third one of the layers being a phosphor layer, wherein the phosphor layer includes a material that is operable to convert a first spectrum of light emitted by the LED devices to a second spectrum that is different from the first spectrum.

2. The lighting apparatus of claim 1, wherein the material contains phosphor particles.

3. The lighting apparatus of claim 1, wherein the cap further includes a diffuser material that is operable to scatter the light emitted by the LED devices, and wherein the diffuser material is disposed in the diffuser layer.

4. The lighting apparatus of claim 1, wherein the LED devices each include a blue die emitter that is free of a phosphor coating.

5. The lighting apparatus of claim 1, wherein the cap circumferentially covers the LED devices.

6. The lighting apparatus of claim 1, wherein the cap includes a side portion that circumferentially surrounds the LED devices, and wherein the LED devices are sealed by the cap and the substrate.

7. The lighting apparatus of claim 1, wherein:

the cap covers a first subset of the LED devices while exposing a second subset of the LED devices;

the first subset of the LED devices are each free of a phosphor coating; and the second subset of the LED devices each include a phosphor coating.

8. The lighting apparatus of claim 7, wherein a ratio between a diameter of the cap to a diameter of the substrate is about 3:5.

9. The lighting apparatus of claim 1, wherein the distance separating the cap and the LED devices is greater than about 0.5 millimeters.

10. The lighting apparatus of claim 1, further comprising:

a heat sink coupled to the substrate, the heat sink being operable to dissipate thermal energy generated by the LED devices; and a diffuser cap disposed over the LED devices and over the cap, wherein the diffuser cap includes a diffuser material that is operable to scatter the light emitted by the LED devices.

11. A lamp, comprising:

a plurality of light-emitting diode (LED) light sources located on a substrate, at least a subset of the LED light sources being free of a phosphor coating;

a cap structure located over at least the subset of the LED light sources, the cap structure containing a phosphor material and a diffuser material, wherein the cap structure is physically separated from the subset of the LED light sources by a gap, wherein the cap structure is positioned in a manner such that it overlaps a first subset of the LED light sources from a top view and exposes a second subset of the LED light sources from a top view, the first subset of the LED light sources being non-phosphor-coated devices, the second subset of the LED light sources being phosphor-coated devices, and wherein the cap structure includes a substrate layer, a diffuser layer, and a phosphor layer, wherein the substrate layer is separated from the phosphor layer, wherein the phosphor material is disposed within the phosphor layer, and wherein the diffuser material is disposed within the diffuser layer; and a cover structure positioned over and surrounding the LED light sources and the cap structure.

12. The lamp of claim 11, wherein the gap is in a range from about 0.5 millimeters to about 10 millimeters.

13. The lamp of claim 11, wherein the first subset of the LED light sources is enclosed by the substrate and the cap structure.

14. The lamp of claim 13, wherein the cap structure includes:

a substantially flat first portion that overlaps the first subset of the LED light sources from the top view; and a substantially flat second portion that segregates the first subset of the LED light sources from the second subset of the LED light sources from a cross-sectional view.

15. The lamp of claim 11, wherein the cover structure contains diffuser particles.

16. The lamp of claim 11, wherein the phosphor layer of the cap structure is disposed closer to the LED light sources than the diffuser layer of the cap structure.

17. A method of fabricating a lighting apparatus, comprising:

forming a plurality of light-emitting diode (LED) devices on a substrate;

assembling a phosphor-containing cap structure over the substrate, the cap structure circumferentially covering at least a subset of the LED devices, wherein a gap physically separates the cap structure from the LED devices, and wherein the cap structure includes a substrate layer, a diffuser layer, and a phosphor layer, wherein the substrate layer is separated from the phosphor layer, wherein a phosphor material is disposed within the phosphor layer, and wherein a diffuser material is disposed within the diffuser layer; and attaching a cover to the substrate, the cover and the substrate completely enclosing the LED devices.

18. The method of claim 17, wherein the cap structure is formed using one of: a roll to roll process, a mask process, and an injection molding process.

19. The method of claim 17, wherein the cover contains a diffuser material.

20. The method of claim 17, wherein the assembling the cap structure is carried out in a manner so that the cap structure assumes one of the following configurations relative to the LED devices:

the cap structure blocks all of the LED devices from a top view but not from a side view;

the cap structure blocks all of the LED devices from the top view and from the side view; and the cap structure blocks a first subset of the LED devices from the top view and exposes a second subset of the LED devices from the top view, the first subset of the LED devices being non-phosphor-coated devices, the second subset of the LED devices being phosphor-coated devices.

* * * * *